US008677881B2

(12) United States Patent
Tillotson et al.

(10) Patent No.: US 8,677,881 B2
(45) Date of Patent: Mar. 25, 2014

(54) METHOD AND SYSTEM FOR ATTENUATING SHOCK WAVES VIA AN INFLATABLE ENCLOSURE

(75) Inventors: Brian J. Tillotson, Kent, WA (US); Brian G. Fischer, Bothell, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 13/443,345

(22) Filed: Apr. 10, 2012

(65) Prior Publication Data

US 2013/0263726 A1 Oct. 10, 2013

(51) Int. Cl.
*F41H 5/24* (2006.01)

(52) U.S. Cl.
USPC ..... 89/36.04; 89/36.01

(58) Field of Classification Search
USPC ..... 89/36.01, 36.02, 36.04, 36.07, 36.08, 89/36.09, 36.12
See application file for complete search history.

(56) References Cited

U.S. PATENT DOCUMENTS

| | | | | |
|---|---|---|---|---|
| 1,195,042 | A | 8/1916 | Leon | |
| 2,405,694 | A | 8/1946 | Nicolas | |
| 2,513,279 | A | 7/1950 | Albert | |
| 3,050,707 | A | 8/1962 | Baker et al. | |
| 3,660,951 | A * | 5/1972 | Cadwell | 52/2.18 |
| 3,875,844 | A | 4/1975 | Hicks | |
| 3,943,870 | A | 3/1976 | Paslay | |
| 4,215,630 | A | 8/1980 | Hagelberg et al. | |
| 4,313,181 | A | 1/1982 | Holm | |
| 4,543,872 | A * | 10/1985 | Graham et al. | 86/50 |
| H1231 | H | 9/1993 | Richards | |
| 5,341,718 | A | 8/1994 | Woodall et al. | |
| 5,394,786 | A | 3/1995 | Gettle et al. | |
| 5,400,688 | A | 3/1995 | Eninger et al. | |
| 5,739,458 | A * | 4/1998 | Girard | 89/36.02 |
| 6,029,558 | A | 2/2000 | Stevens et al. | |
| 6,256,263 | B1 | 7/2001 | Stevens | |
| 6,266,926 | B1 | 7/2001 | Figge et al. | |
| 6,279,449 | B1 * | 8/2001 | Ladika et al. | 89/36.17 |
| 6,412,391 | B1 | 7/2002 | Stevens et al. | |
| 6,595,102 | B2 | 7/2003 | Stevens et al. | |
| 6,653,972 | B1 | 11/2003 | Krikorian et al. | |
| 6,782,790 | B2 | 8/2004 | Barrett | |
| 7,077,049 | B2 | 7/2006 | Shumov et al. | |
| 7,213,494 | B2 * | 5/2007 | James | 86/50 |
| 7,421,936 | B2 * | 9/2008 | Barger et al. | 89/36.02 |

(Continued)

FOREIGN PATENT DOCUMENTS

| | | |
|---|---|---|
| WO | 97/16697 | 5/1997 |
| WO | 2011/148165 | 12/2011 |

*Primary Examiner* — Benjamin P Lee
(74) *Attorney, Agent, or Firm* — Clifford G. Cousins

(57) ABSTRACT

According to an embodiment, a method for attenuating shock waves may include detecting at least one of an incoming hostile threat or electromagnetic radiation from an explosion from the hostile threat and filling an enclosure with a gas, the enclosure being positioned between the explosion and a region to be protected. According to one embodiment, a system may include a sensor configured to detect at least one of the direction of an incoming threat and an explosion from the incoming threat, an inflatable enclosure, and an inflation device configured to receive a trigger signal from the sensor indicating the arrival of the threat or explosion from the threat and inflate the inflatable enclosure in time to allow the inflated enclosure to reflect, absorb and/or refract and defocus at least a portion of the shock wave from the explosion before it reaches the protected region.

22 Claims, 5 Drawing Sheets

(56) References Cited

U.S. PATENT DOCUMENTS

| | | | | |
|---|---|---|---|---|
| 7,437,987 | B1 | 10/2008 | Ohnstad et al. | |
| 7,827,900 | B2 | 11/2010 | Beach et al. | |
| 7,866,250 | B2 * | 1/2011 | Farinella et al. | 89/36.17 |
| 7,878,103 | B2 * | 2/2011 | Imholt et al. | 89/36.08 |
| 8,042,449 | B2 * | 10/2011 | Farinella et al. | 89/36.01 |
| 8,051,762 | B2 | 11/2011 | Beach et al. | |
| 8,141,470 | B1 * | 3/2012 | Farinella et al. | 89/36.01 |
| 8,151,710 | B2 | 4/2012 | Fu et al. | |
| 2004/0107827 | A1 | 6/2004 | Edberg et al. | |
| 2007/0006723 | A1 | 1/2007 | Waddell, Jr. et al. | |
| 2007/0180983 | A1 * | 8/2007 | Farinella et al. | 89/36.07 |
| 2008/0190276 | A1 * | 8/2008 | Barger et al. | 89/36.02 |
| 2009/0114084 | A1 | 5/2009 | Thinn et al. | |
| 2009/0266226 | A1 | 10/2009 | Beach et al. | |
| 2010/0319524 | A1 * | 12/2010 | Farinella et al. | 89/36.02 |
| 2010/0319526 | A1 | 12/2010 | Imholt et al. | |
| 2011/0120294 | A1 | 5/2011 | Beach et al. | |
| 2011/0168004 | A1 * | 7/2011 | Henegar | 89/36.02 |
| 2011/0297031 | A1 | 12/2011 | Fu et al. | |
| 2012/0060677 | A1 * | 3/2012 | Farinella et al. | 89/36.02 |

* cited by examiner

METHOD AND SYSTEM FOR ATTENUATING SHOCK WAVES VIA AN INFLATABLE ENCLOSURE

FIELD

The present disclosure relates to methods and systems for attenuating the force of a shock wave, and more particularly, methods and systems for attenuating the force of an approaching shock wave caused by an explosive device by altering the amplitude and direction of travel of the shock wave.

BACKGROUND

Explosive ordnance commonly features an explosive charge encased within a warhead. The warhead may be self-propelled, as the payload of a missile or rocket-propelled grenade (RPG), or it may be ballistic, as the payload of a mortar round, shell or an unguided air-to-ground bomb. Such explosive ordnance creates destruction and injury in two principal ways.

First, when detonated, the explosive charge creates a heated volume of gas and plasma that expands rapidly and disintegrates the warhead in which it is contained. Pieces of the disintegrated warhead create high-velocity shrapnel that may impact and damage surrounding structures, including vehicles, and personnel. Stationary structures may be hardened to protect against the damage caused by shrapnel. Protective armor may be applied to vehicles to lessen the damage caused by shrapnel, but such armor adds to the weight of the vehicle, which may negatively affect its performance. Body armor may be worn by individuals, but is less effective. Such armor typically leaves portions of the individual, such as the head, arms and legs, unprotected. Size and weight of such armor is limited to what may be carried by an individual in addition to other equipment, and typically is not sufficient to protect the wearer completely.

Second, detonation of the explosive charge creates an expanding volume of hot gases and heated plasma caused by rapid combustion of the explosive charge. The outer boundary of the expanding volume of hot gases and plasma forms a pressure shock wave. Depending upon the energy released by the detonation of the explosive charge of the warhead, this shock wave may contain sufficient energy to severely damage adjacent structures, including vehicles, and cause injury or death to personnel it impacts. Stationary structures may be hardened to withstand the energy imparted by such shock waves. Adding armor to vehicles is less effective, especially with respect to lighter vehicles, which cannot carry heavy armor. Personnel may be particularly vulnerable to high-energy shock waves caused by exploding ordnance. For example, a shock wave from an explosion may at a minimum damage a person's ear drums, and at higher energy levels, can damage internal organs, such as by causing a person's brain to impact his skull to cause a concussion, or damage internal organs to the point of killing the individual.

Accordingly, there is a need to develop a countermeasure that can lessen the destructive effect of shock waves caused by exploding ordnance. Such a countermeasure preferably should be capable of deployment on the order of milliseconds once explosive ordnance or explosion therefrom has been detected.

SUMMARY

The present disclosure is directed to a method and system for attenuating a shock wave by interposing an inflated enclosure between the advancing shock wave and a region to be protected. In one particular aspect, the method and system may be used to counteract the force of a shock wave created by detonation of an explosive associated with an incoming hostile threat. By placing the inflated enclosure between the shock wave and the protected region, the enclosure and/or the gas it contains diminish the effect of the shock wave on the protected region by reflecting at least a portion of the shock wave, refracting and defocusing at least a portion of the shock wave, and/or absorbing at least a portion of the shock wave.

In one aspect, the inflated enclosure may be filled with a gas at a pressure above ambient pressure and at a temperature above or below ambient temperature. The differences in temperature and pressure of the volume of gas in the inflated enclosure from ambient may change the refractive index at the boundary between ambient air in which the shock wave travels and the gas within the inflated enclosure. This difference may act to reflect, or refract and defocus the shock wave such that only a small portion of the shock wave may reach the protected area. Further, the material of the enclosure itself also may act to reflect, absorb and/or refract and defocus the shock wave. These effects may occur when the shock wave first encounters the inflated enclosure and when the shock wave leaves the inflated enclosure before reaching the protected region. In one aspect, the volume of pressurized gas contained in the inflated enclosure may act as a lens to "steer" the shock wave and hot gases from the incoming threat away from the intended target.

According to one embodiment, a method of protecting a region may include sensing at least one of an incoming hostile threat or electromagnetic radiation from an explosion from the hostile threat relative to the protected region, and inflating an inflatable enclosure with a gas in response to sensing the incoming threat such that it is positioned substantially between a shock wave from an explosion from the hostile threat and the protected region. The gas in the inflatable enclosure may diminish the effect of the shock wave on the protected region by at least one of reflecting at least a portion of the shock wave, refracting and defocusing at least a portion of the shock wave, and absorbing at least a portion of the shock wave before it reaches the protected region. In one aspect, the method may include providing an inflation device to store the inflatable enclosure in a collapsed state, and rapidly inflating the inflatable enclosure with a pressurized gas in response sensing at least one of an incoming hostile threat or electromagnetic radiation from an explosion from the hostile threat.

According to another embodiment, a system for controlling the shape and direction of an explosion may include a sensor configured to detect at least one of an incoming hostile threat or electromagnetic radiation from an explosion from the hostile threat. The sensor preferably is capable of predicting a vector of a shock wave from the explosion relative to a protected region and generating a trigger signal in response thereto. The system may include an inflatable enclosure configured to retain pressurized gas in a predetermined shape when inflated, and an inflation device connected to receive the trigger signal from the sensor.

The inflatable enclosure may be stored in a deflated, folded configuration within the inflation device. The inflation device may include a housing that receives the stored inflatable enclosure and may include doors that swing outwardly in response to expansion of the inflatable enclosure. The housing may include resilient cables to attach the housing to a substrate, such as the ground. The inflation device may include one or more gas generation units in communication with the inflatable enclosure. In some embodiments, one or more sensors may be mounted on the inflation device.

In one aspect, the sensor may be selected to detect an explosion caused by an incoming threat before the resultant shock wave reaches the item the system is to protect. The sensor may be selected to detect electromagnetic radiation created by detonation of an explosive associated with the incoming threat, because such radiation travels at light speed and will reach the sensor before the shock wave. The electromagnetic radiation may include microwave bursts, and flashes of radiation in one or more of the x-ray, infrared, visible light and ultraviolet portions of the electromagnetic spectrum.

In one embodiment, the system may include a plurality of units placed around a protected region, for example a military tent. Each unit may include a sensor, inflation device and inflatable enclosure and operate independently of the other units. The units may be spaced such that, when inflated, the inflatable enclosures may form a substantially continuous barrier about the protected region. In another embodiment, the system may utilize a remote trigger in place of a sensor. The trigger may be actuated by an individual, such as a special operations soldier, within the protected region in response to a known explosion such as a concussion grenade, or placed close to friendly fire. Such units may be sized to be relatively light and capable of being transported and deployed by individual soldiers.

Other objects and advantages of the disclosed method and system will be apparent from the following description, the accompanying drawings and the appended claims.

DETAILED DESCRIPTION

Figure 1:
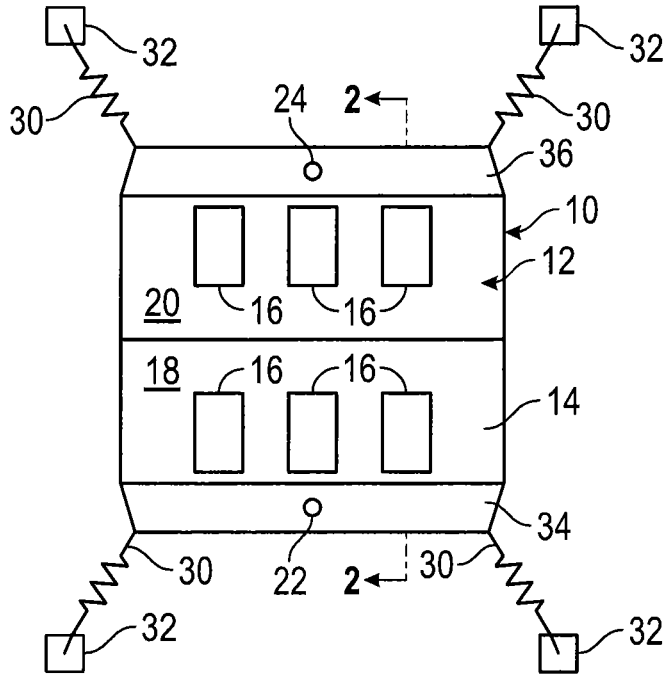
FIG. 1 is a schematic top plan view of the inflation device housing of one embodiment of the disclosed system for attenuating shock waves via an inflatable enclosure, in which the system is not deployed.
Figure 2:
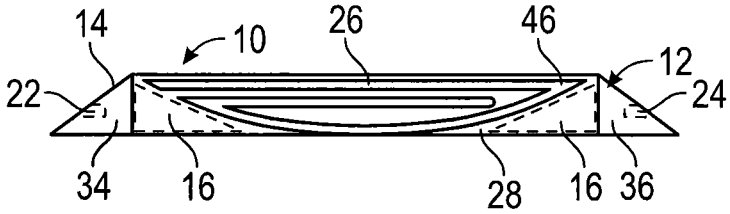
FIG. 2 is a schematic side elevation in section taken at line 2-2 of FIG. 1 showing details of the location of the gas generation units and sensors.
Figure 4:
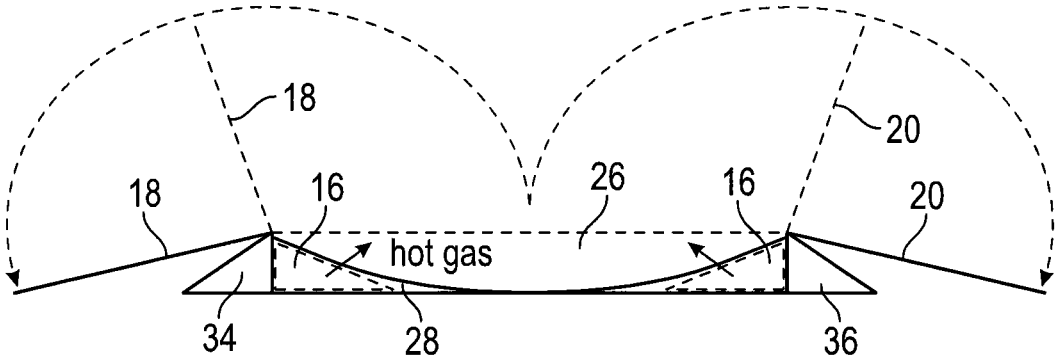
FIG. 4 is a schematic, side elevation in section showing the inflation device of FIG. 1 in which the doors are open.
Figure 3:
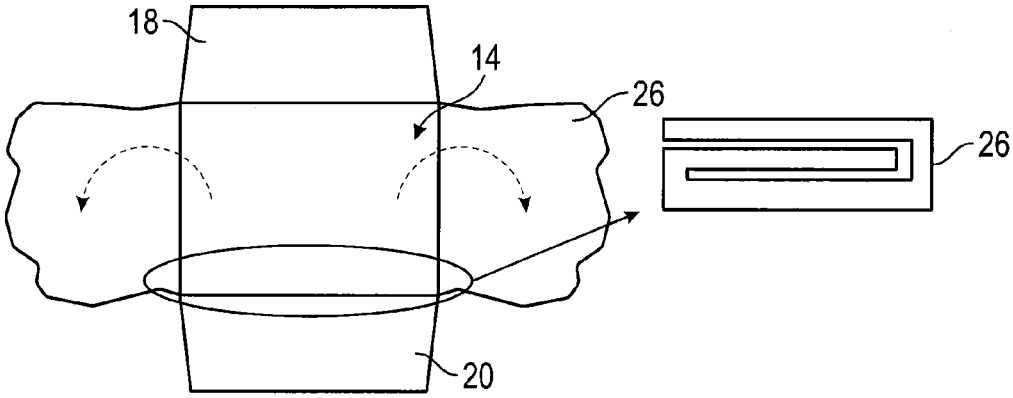
FIG. 3 is a schematic top plan view of the inflation device of FIG. 1 showing the housing doors open and the inflatable enclosure deployed, and a detail showing a folded inflatable enclosure.

As shown in FIGS. 1, 2 and 3, the disclosed system for attenuating shock waves, generally designated 10, may include an inflation device 12 that may include a housing 14, gas generating units 16, and pivoting doors 18, 20 (see also FIG. 4). The system also may include sensors 22, 24 and inflatable structure, e.g., an inflatable enclosure 26, shown folded and stored in a cavity 28 within the housing 14 and covered by the doors 18, 20.

The housing 14 may include resilient connectors 30, such as springs, to attach the housing 14 to a substrate or support 32, which may be the ground. It is within the scope of the disclosure to provide connectors 30 at each corner of the housing 14. The housing 14 may be made of steel or plastic, and in the embodiment shown in the drawing figures, have generally a truncated prism shape. The cavity 28 may be bordered by side rails 34, 36 within which are mounted the sensors 22, 24. The side rails 34, 36 also may support the doors 18, 20, retain sensors 22, 24 and store connectors 30 when not in use.

The sensors 22, 24 may be selected to detect electromagnetic radiation of the type generated by an explosion 38 (see FIG. 8) from a hostile threat 40, such as an incoming mortar round, RPG, missile, howitzer shell, unguided air-to-ground bomb, Claymore mine, improvised explosive device (IED), and the like. The electromagnetic radiation from the explosion 38 may be in the form of one or more of a burst of microwaves, infrared radiation, x-rays, and visible light. Sensors 22, 24 also may be configured to detect a burst of radiation in the form of gamma rays and neutrons of the type given off by a low yield nuclear explosion 38 also may be detected. These types of radiation all travel at or near light speed, faster than the shock wave 42, and therefore will reach and be detected by the sensors 22, 24 in advance of the arrival of the shock wave 38 so that the system 10 may have sufficient time (on the order of milliseconds) to deploy the inflatable enclosure 26.

In one embodiment, the one or more of the sensors 22, 24 may be configured to detect one or more of the magnitude, elevation, azimuthal angle, distance and signature (i.e., type) of the explosion 38, and from those parameters determine whether the shock wave 42 from the explosion 38 will pose a threat to the protected region 44. Once that decision is reached, the sensor determines an optimal time to deploy the inflatable enclosure 26.

In one embodiment, one or more of the sensors 22, 24 may be configured to detect the incoming hostile threat 40 itself. In this embodiment, sensor 22, for example, may track the trajectory of incoming threat 40, in the case of a moving, as opposed to stationary, threat. By measuring such attributes as motion, altitude, distance, velocity and azimuthal angle, the sensor 22 may determine whether the incoming threat 40 will pose a danger to protected region 44, and determine an optimal time to deploy inflatable enclosure 26. In other embodiments, the system 10 may include sensors 22, 24, each for detecting and tracking the incoming hostile threat 40, in which case the sensors may triangulate on the incoming hostile threat 40. In other embodiments, the system 10 may include sensors 22, 24, each for detecting an explosion 38, or one or more sensors 22, 24 for detecting both an incoming hostile threat 40 and an explosion 38.

Figure 5:
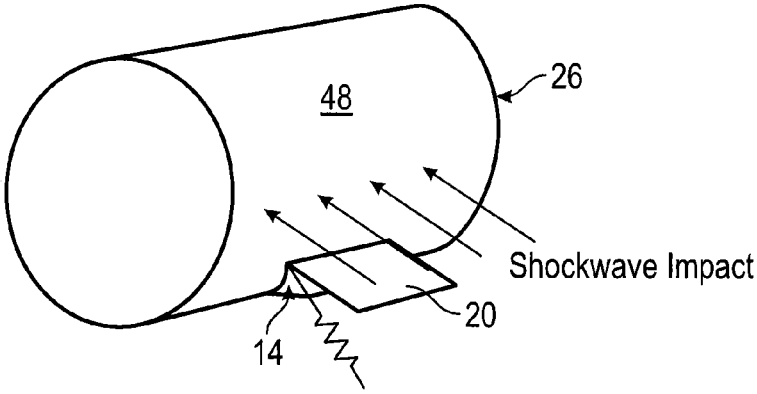
FIG. 5 is a schematic, perspective view of the disclosed system in which the inflatable enclosure is shown inflated.

The inflatable enclosure 26 may be made of a thin, flexible, gas-impermeable skin of silk, woven nylon, polyester film (e.g., Mylar, a trademark of DuPont Teijin Films LP), aluminized polyester film, para-aramid synthetic fiber (e.g., Kevlar, a trademark of E.I. Du Pont De Nemours and Company), and woven nylon fabric formed into an enclosed volume. As shown in FIGS. 2, 3 and 5, in one embodiment the inflatable enclosure 26 may be folded and stored in the cavity 28 of the housing 14 of the inflation device 12. The inflatable enclosure 26 is connected to the housing 14 and the interior 46 of the enclosure is in fluid communication with the gas generating units 16.

The inflatable enclosure 26 may be formed to have any desired shape. In some embodiments the inflatable enclosure 26 may be selected to have a shape that attenuates a shock wave that comes into contact with it. In one embodiment, the inflatable enclosure 26 is formed to have a convex surface 48 when inflated and deployed. In one embodiment, the inflatable enclosure 26 has a cylindrical shape.

The gas generating units 16 (see FIGS. 1, 2 and 4) in one embodiment may be mounted in the housing 14 at the base of the cavity 28 and are connected to inject gas rapidly into the inflatable enclosure 26. In one embodiment, the gas generators 16 may utilize a solid propellant such as sodium azide, and an oxidizer, which would generate $N_2$ gas when detonated. In one embodiment, the gas generators 16 would be configured to inject an inert, particulate material, such as fine particles of clay, into the inflatable enclosure 26 along with gas. In one embodiment, the particulate material may be produced as a by-product of the combustible material used to create the gas. When dispersed in the interior of the inflated inflatable enclosure 26, the mass of the particulate material may act to absorb and deflect at least a portion of the force of the shock wave 42 as it passes through the inflatable enclosure.

The operation of the system for attenuating shock waves 10 is as follows. Upon detecting an incoming hostile threat 40, and/or an explosion 38 (see FIG. 8), one or more of sensors 22, 24 determine whether a shock wave 42 is likely to severely impact a protected region 44. If so, the sensor or sensors 22, 24 determine when the shock wave 42 may impact the protected region 44, and at the optimal time, trigger the gas generating unit or units 16 in the housing 14 of the inflation device 12 (see FIGS. 1 and 4). The gas generating unit or units 16 may generate gas that rapidly inflates inflatable enclosure 26. This rapid inflation of inflatable enclosure 26 forces open doors 18, 20 of the housing 14, which may be attached to the housing 14 by hinges that may include a detent that keeps the doors 18, 20 in an open configuration (see FIGS. 3, 4 and 5) once opened. As shown in FIG. 4, the doors 18, 20 may be shaped and positioned to lock into position contacting the ground 32 (FIG. 1) and may provide additional stability. The angled shape of the rails 34, 36 may provide clearance for the doors 18, 20 in the open position.

The inflatable enclosure 26 may be folded for storage within the cavity 28 in any way that facilitates rapid unfolding and inflation. An example is shown in FIGS. 2 and 3.

Figure 8:
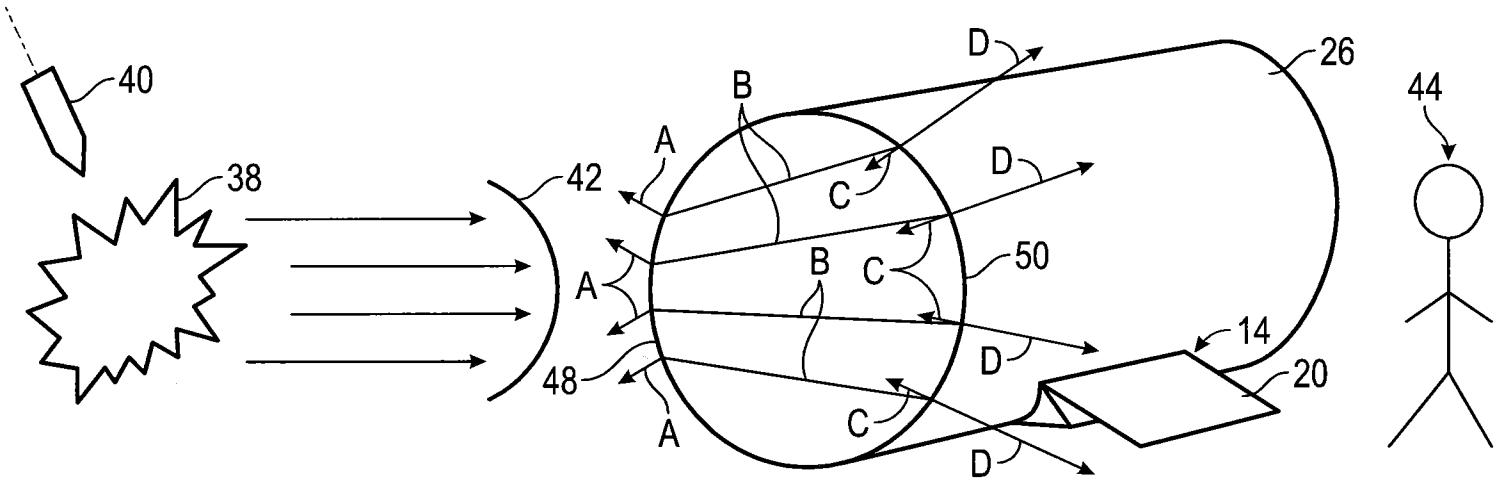
FIG. 8 is a schematic diagram showing an inflated inflatable enclosure diminishing the force of a shock wave from an explosion that reaches a protected region.

The generally cylindrical shape of the inflatable enclosure 26, shown in FIG. 8, may ensure that a convex surface 48 of the enclosure faces the advancing shock wave 42. In one embodiment, at the time the shock wave 42 contacts the now-inflated inflatable enclosure 26, the enclosure is substantially filled (i.e., filled sufficiently to assume its shape) with gas, or gas with particulates dispersed substantially throughout, at a pressure above ambient pressure, and at a temperature above ambient temperature. In another embodiment, a gas is generated to inflate the enclosure 26 with a pressure above ambient pressure and a temperature below ambient temperature.

As shown in FIG. 8, by filling the inflatable enclosure 26 with a gas at a different pressure and temperature than ambient the refractive index of the gas may differ from ambient. Further, all discontinuities in the medium in which the shock wave travels may provide a reflective point for the wave. Discontinuities may include the interface between the ambient air and the leading portion of the skin of the inflatable enclosure 26, the leading portion of the skin and the gas, the gas and the trailing portion of the enclosure skin, and the trailing portion of the enclosure skin and the ambient air each provide a reflective point. Further, discontinuities in the gas also may provide reflective points.

When the shock wave strikes the boundaries—both entering and exiting—of the gas in the enclosure 26, the difference in refractive index values will bend the path of the shock wave. This may cause at least some of the shock wave 42 that contacts the gas in the inflatable enclosure 26 to be reflected from the inflatable enclosure 26, as indicated by arrows A. The convex surface 48 also may act as a lens, causing the shock wave passing into the gas in the interior of the inflatable enclosure 26 to diverge and defocus, as indicated by lines B. The portion of the shock wave contacting the rearward portion 50 of the gas in the inflatable enclosure 26 also may be reflected, as shown by arrows C. And finally, the portion of the shock wave exiting the rearward portion 50 may be further dispersed, as shown by arrows D. In addition the force of the shock wave 42 may be further diminished and defocused by contacting the skin of the inflatable enclosure 26 and/or any particulate material dispersed within the interior of the inflatable enclosure 26. In the case where the gas in the enclosure 26 is at a greater temperature and is less dense than ambient, the speed of the shock wave may decrease when exiting the trailing portion of the gas in the enclosure, and may further diverge and thus decrease in intensity.

Figure 6:
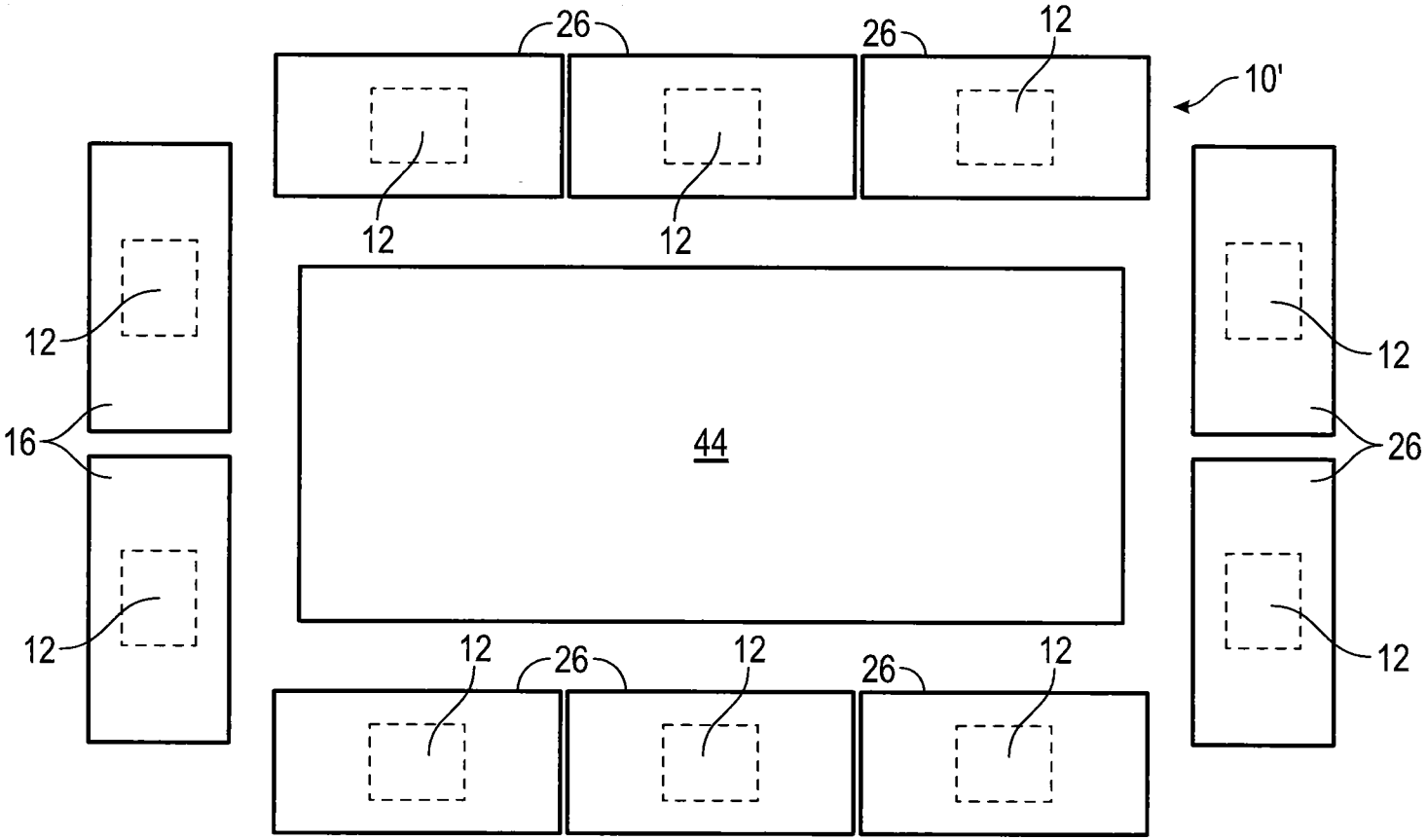
FIG. 6 is a schematic plan view of an embodiment of the disclosed system comprising a plurality of units positioned about a protected region.

As shown in FIG. 6, in one embodiment the system 10' may include a plurality of discrete inflation devices 12 positioned around a protected region 44 that may include a field tent, command bunker, gun emplacement or the like. In one embodiment the inflation devices 12 may be spaced such that, when deployed (i.e., inflated) their respective inflatable enclosures 26 may be substantially adjacent to each other. Each inflation device 12 may have its own independent sensors 22, 24 (see FIG. 1) and operate independently of the others. By way of example, the inflatable enclosures 26 of the system 10' may be shaped to inflate to six feet in height.

Figure 7A:
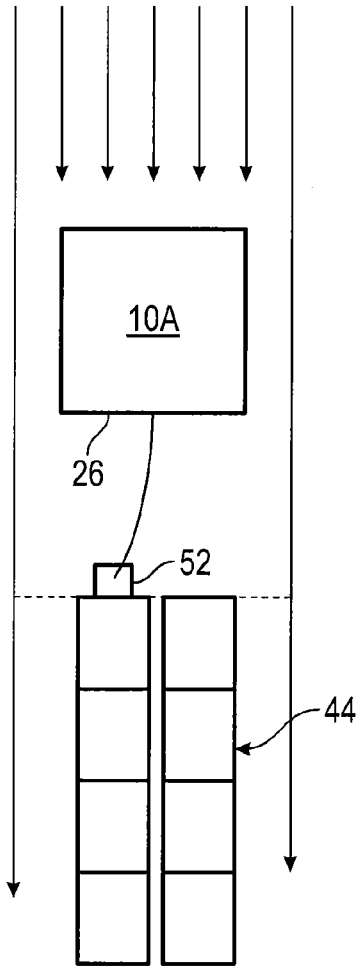
FIGS. 7A and 7B are schematic plan views of an embodiment of the disclosed system comprising portable units.
Figure 7B:
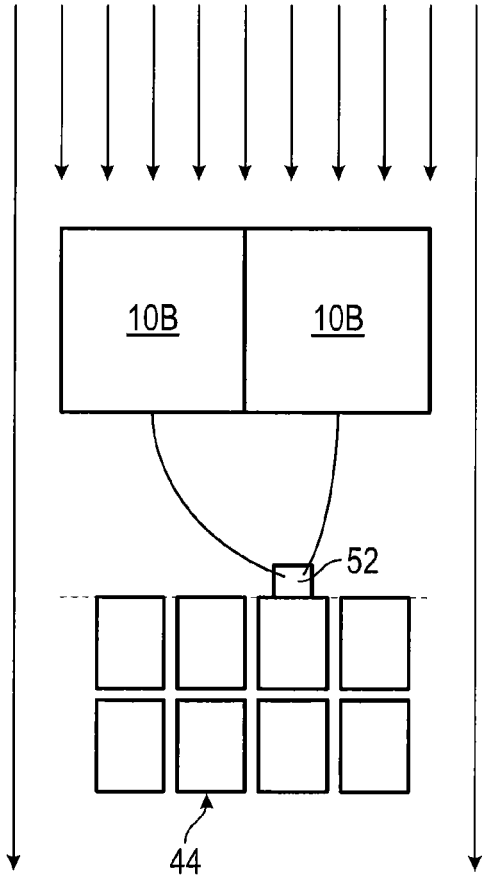

As shown in FIGS. 7A and 7B in one embodiment the system 10A, 10B, 10C may be used to protect a protected region 44 that may comprise special ops troops or special forces. The system 10A, 10B, 10C preferably is smaller, lighter and therefore more portable. By way of example, the embodiment of FIGS. 7A and 7B may be shaped to include an inflatable enclosure 26 that is four feet high and may be used as a defense against incoming hostile threats (see FIG. 8), or to allow troops crouching behind it to detonate ordnance close by without harm to themselves. In this embodiment, the system 10A, 10B, 10C optionally may include a remote control 52 that allows the troops to deploy the inflatable enclosure 26 (see FIG. 8) on command.

Each of the disclosed embodiments may include a static enclosure that may be rapidly filled with a gas above ambient pressure and above or below ambient temperature in the path of an incoming shock wave from an explosion that otherwise may damage or destroy a protected region. The static enclosure attenuates the energy and pressure of the shock wave by at least one of reflection from both the forward and rearward boundaries of the gas in the enclosure, refraction and dispersion of the shock wave as it passes through the gas in the enclosure, and absorption of the shock wave by the enclosure and the gas within the enclosure. Thus, the enclosure and gas within may act as a diverging lens—especially if the enclosure is shaped to have a convex leading edge.

While the methods and forms of apparatus described herein may constitute preferred aspects of the disclosed method and apparatus, it is to be understood that the invention is not limited to these precise aspects, and that changes may be made therein without departing from the scope of the invention.

What is claimed is:

1. A system for protecting a protected region from shock waves, the system comprising:

a sensor configured to detect at least one of a hostile threat or electromagnetic radiation from an explosion from the hostile threat, the sensor programmed to predict therefrom a vector and an arrival time of a shock wave from the explosion relative to a protected region and generate a trigger signal in response thereto;

an inflatable enclosure configured to retain gas in a predetermined shape when the enclosure is substantially inflated by the gas;

an inflation device connected to receive the trigger signal from the sensor and connected to the inflatable enclosure, the inflation device being configured to supply the gas to the inflatable enclosure in response to the trigger signal from the sensor in time to substantially inflate the inflatable enclosure prior to the shock wave arrival, the inflatable enclosure being shaped such that, when inflated by the gas, the retained gas diminishes an effect of the shock wave on the protected region by at least one of reflecting at least a portion of the shock wave, refracting and defocusing at least a portion of the shock wave, and absorbing at least a portion of the shock wave.

2. The system of claim 1, wherein the sensor is configured to detect one or more of the magnitude, elevation, azimuthal angle, distance and signature of the explosion, and determine therefrom whether the shock wave from the explosion will pose a threat to the protected region and if so, determine an optimal time to generate the trigger signal.

3. The system of claim 1, wherein:

at least one part of the inflatable enclosure is convex shaped when substantially inflated by the gas; and the properties of the gas are selected so that a speed of a shock wave in the gas is one of faster than or slower than the speed of the shock wave in ambient air adjacent to the inflatable enclosure.

4. The system of claim 1, wherein the at least one part of the inflatable enclosure is oriented at an angle with respect to the shock wave, and said angle chosen to maximize reflection of the shock wave by the retained gas.

5. The system of claim 3, wherein the inflatable enclosure is composed of material selected from silk, polyester film, aluminized polyester film, para-aramid synthetic fiber and woven nylon fabric.

6. The system of claim 1, wherein the inflatable enclosure is shaped to have a forward portion and a rearward portion such that the forward portion and rearward portion are positioned between the protected region and shock wave.

7. The system of claim 1, wherein the inflation device includes a housing; and the inflatable enclosure is stored substantially within the housing prior to inflation.

8. The system of claim 7, wherein the inflation device includes a gas generation unit located within the housing and in communication with the inflatable enclosure.

9. The system of claim 7, wherein the sensor is mounted on the housing.

10. The system of claim 7, wherein the housing has generally a truncated prism shape.

11. The system of claim 1, further comprising a plurality of sensors, inflation devices and inflatable enclosures arranged substantially around the protected region.

12. The system of claim 1, wherein the inflation device is configured to supply particulate material dispersed through the gas to the inflatable enclosure.

13. The system of claim 7, wherein the housing includes resilient connectors for attaching the housing to a support.

14. The system of claim 1, wherein the inflation device is configured to fill the inflatable enclosure with the gas to at least one of a pressure above ambient pressure and a temperature at one of above ambient temperature and below ambient temperature.

15. A method of protecting a protected region, the method comprising:

detecting by a sensor at least one of a hostile threat or electromagnetic radiation from an explosion from the hostile threat relative to the protected region, predicting therefrom a vector and an arrival time of a shock wave from the explosion relative to the protected region, and generating a trigger signal in response thereto;

providing an inflatable enclosure positioned such that, when inflated, the inflated enclosure is substantially between a location of the explosion from the hostile threat and the protected region;

providing an inflation device to receive the trigger signal from the sensor, and in response thereto, substantially inflate the inflatable enclosure in time to protect the protected region from the shock wave from the explosion, the inflatable enclosure being configured to retain a gas in a predetermined shape when the enclosure is substantially fully inflated, whereby the inflated inflatable enclosure diminishes an effect of the shock wave on the protected region by at least one of reflecting at least a portion of the shock wave, refracting and defocusing at least a portion of the shock wave, and absorbing at least a portion of the shock wave.

16. The method of claim 15, further comprising attenuating the shock wave at least partially in a direction toward the protected region.

17. The method of claim 15, wherein the step of providing a sensor includes providing a sensor configured to detect one or more of the magnitude, elevation, azimuthal angle, distance and signature of the explosion, and determine therefrom whether the shock wave from the explosion will pose a threat to the protected region, and if so, determining an optimal time to generate the trigger signal.

18. The method of claim 15, further comprising positioning the inflation device and the inflatable enclosure adjacent to the protected region.

19. The method of claim 15, further comprising positioning the protected region adjacent to the inflatable enclosure.

20. The method of claim 15, further comprising positioning a plurality of the inflation devices substantially about the protected region.

21. The method of claim 20, wherein positioning a plurality of the inflation devices includes providing a plurality of the sensors and a plurality of the inflation devices, each of the sensors and the inflation devices connected to trigger a different one of the plurality of the inflation devices.

22. The method of claim 21, wherein providing a plurality of sensors includes spacing the plurality of sensors substantially about the protected region.

* * * * *